US005555756A

United States Patent [19]

Fischer et al.

[11] Patent Number: 5,555,756

[45] Date of Patent: Sep. 17, 1996

[54] METHOD OF LUBRICATING STEEL STRIP FOR COLD ROLLING, PARTICULARLY TEMPER ROLLING

[75] Inventors: Harold L. Fischer, Chesterton; Ajay K. Singh, Griffith; John M. Stadnik, Jr., Schererville, all of Ind.

[73] Assignee: Inland Steel Company, Chicago, Ill.

[21] Appl. No.: 377,453

[22] Filed: Jan. 24, 1995

[51] Int. Cl.[6] ..... B21B 45/02; B21B 45/00

[52] U.S. Cl. ..... 72/41; 72/42; 72/47

[58] Field of Search ..... 72/39, 40, 41, 72/42, 47, 234; 252/49.3, 49.5

[56] References Cited

U.S. PATENT DOCUMENTS

| | | | |
|---|---|---|---|
| 3,698,932 | 10/1972 | Dean | 29/195 |
| 4,032,678 | 6/1977 | Perfetti et al. | 427/388 A |
| 4,191,801 | 3/1980 | Jahnke | 428/467 |
| 4,321,308 | 3/1982 | Jahnke | 428/469 |
| 4,752,405 | 6/1988 | Kyle et al. | 252/49.3 |
| 4,753,743 | 6/1988 | Sech | 252/33.4 |
| 4,812,365 | 3/1989 | Saunders et al. | 428/469 |
| 4,846,986 | 7/1989 | Trivett | 252/49.5 |
| 4,999,241 | 3/1991 | Coduti et al. | 428/340 |
| 5,151,297 | 9/1992 | Robbins et al. | 427/46 |
| 5,197,179 | 3/1993 | Sendzimir et al. | 72/39 |
| 5,248,528 | 9/1993 | Robbins et al. | 427/522 |
| 5,279,141 | 1/1994 | Kenmochi et al. | 72/41 |
| 5,282,376 | 2/1994 | Steele et al. | 72/43 |
| 5,391,396 | 2/1995 | Morrand | 427/156 |

FOREIGN PATENT DOCUMENTS

| | | |
|---|---|---|
| 0043182A1 | 1/1982 | European Pat. Off. . |
| 2629103 | 9/1989 | France . |
| 2097802 | 11/1982 | United Kingdom . |

OTHER PUBLICATIONS

Phillip L. Coduti, "The Production and Implementation of Prelubricated Cold Rolled Steel©" *Lubrication Engineering*, vol. 42, 9, 532–538 (Sep. 1986).

*Primary Examiner*—Lowell A. Larson
*Assistant Examiner*—Rodney Butler
*Attorney, Agent, or Firm*—Marshall, O'Toole, Gerstein, Murray & Borun

[57] ABSTRACT

A method of processing steel strip such that the steel strip can be temper rolled at the increased speeds and better surface texture control of prior art dry lubricants, yet the steel strip can be temper rolled with less frequent replacement of temper mill working rolls. Further, the resulting steel strip has increased stretchability and can be temper rolled to achieve sufficient reduction of YPE at lower working roll pressures and/or lower strip tension, previously only effective when the steel strip was lubricated with a wet lubricant film. Enhanced corrosion resistance is another advantage of this process.

32 Claims, 3 Drawing Sheets

METHOD OF LUBRICATING STEEL STRIP FOR COLD ROLLING, PARTICULARLY TEMPER ROLLING

FIELD OF THE INVENTION

The present invention is directed to the application of a solid lubricant, that also functions as a corrosion inhibitor, on steel strip and, more particularly, to the application of a solid lubricant to steel strip that includes a surface of zinc or aluminum, or alloys thereof, e.g., a galvanized, galvannealed, or aluminized surface. The solid lubricant substantially reduces or prevents the formation of metal oxides on the surface of the steel strip and provides excellent lubrication on the surface of the steel strip for in-line or stand-alone metal working and metal fabrication operations, particularly for temper rolling and cold rolling.

BACKGROUND OF THE INVENTION

When a steel strip is subjected to a metal working or fabrication operation, such as a temper rolling process, it is desirable for the steel strip to have a film of lubricant thereon to facilitate the particular operation. Generally, the lubricant film can be either solid or liquid. Particularly in a temper mill, liquid lubricants have certain advantages, and dry lubricants have other advantages. Steel strip can be temper rolled at a faster rate using a dry lubricant film, and dry lubricant films provide for more exact transfer of the surface texture of temper mill working rolls to the surface of the steel strip. Further, dry lubricants permit the use of automatic shape correction apparatus used as a step in the temper rolling process to assure a flat, uniform surface on the steel strip.

On the other hand, there are advantages to using a wet lubricant film during the temper rolling process. One advantage of wet lubricants for the temper rolling process is in providing more lubricity to the surface of the steel strip, thereby permitting the use of a greater force against the steel strip by the working rolls of the temper mill, resulting in increased stretchability of the resulting steel strip, and/or requiring less interstand tension in a two-stand temper mill, or less back-up tension in a single-stand temper mill. Another substantial advantage of using a wet lubricant during the temper rolling of steel strip is that wet lubricants can be applied to the surface of the steel strip under fluid pressure sufficient to remove much of the dust, dirt and other contaminants that may be on the surface of the steel strip entering the temper mill. Such contaminants are picked up by the surfaces of the working rolls of the temper mill using extant dry lubricant films. Any defects imparted to the surface of the temper mill working rolls are imparted to the surface of temper rolled steel strip. As a result, contaminant-carrying working rolls must be replaced periodically. Using a wet lubricant film during temper milling has the advantage of much less frequent replacement of the temper mill working rolls, e.g., 10–25 rolls of steel strip can be temper rolled without temper mill working roll replacement versus about 6 rolls of steel strip using extant dry lubricants.

Wet lubricants, however, have other disadvantages, such as either requiring a substantial amount of organic liquid solvent for completely coating the steel strip, thereby presenting a fire hazard; or with the use of water as the wet lubricant carrier, aqueous lubricant compositions are detrimental to corrosion resistance properties.

SUMMARY OF THE INVENTION

In brief, the present invention is directed to a method of processing steel strip such that the steel strip can be temper rolled at the increased speeds and better surface texture control of prior art dry lubricants, yet the steel strip can be temper rolled with less frequent replacement of temper mill working rolls. Further, the resulting steel strip has increased stretchability and can be temper milled to achieve sufficient reduction of YPE at lower working roll pressures and/or lower strip tension, previously only effective when the steel strip was lubricated with a wet lubricant film.

The method of the present invention employs an aqueous composition, capable of providing a dry lubricating film as a direct replacement for a wet lubricating composition containing flammable organic solvents, and increases the speed of the steel strip treating operation where the lubricant is applied, e.g., temper rolling, cold rolling, drawing, stamping, blanking, or the like. Fire hazards associated with organic liquid-containing lubricants are eliminated and much faster temper rolling is achieved, at speeds that are only limited by the mechanical means used to move the steel strip through the temper mill, presently on the order of about 2,500 to about 5,000 feet per minute (762 to 1,524 meters per minute).

The solid (dry) lubricant applied to steel strip in accordance with the process of the present invention preferably is applied in the form of an aqueous solution or emulsion. The lubricant composition application procedure can be in-line or stand-alone (separate from the steel processing line). When applied in-line and used as a replacement for a wet lubricant, the steel strip processing line can be substantially faster than a processing line using a wet lubricant, particularly for an in-line steel processing method including a temper rolling process. In-line application refers to application during processing of the steel strip in the steel mill, for example, during the process of galvanizing, aluminizing or galvannealing steel strip and during cold rolling processes (including temper rolling). Stand-alone, or external application refers to the application of the solid lubricant composition at an external processing line, separate and apart from a steel mill processing line.

The solid film-forming lubricant composition preferred in accordance with the process of the present invention is fully disclosed in a patent application of Wysong, et al. filed Jun. 11, 1994 by DuPont Corporation (Ser. No. 08/258,113). This composition is particularly advantageous for providing corrosion resistance and lubrication of steel strip on route to a temper mill. This composition is particularly advantageous for steel strip that includes an alloy coating of iron with zinc or aluminum, commonly produced on a steel strip through a process such as galvanizing, galvannealing, or aluminizing. The process of the present invention also is useful for providing a solid lubricant/corrosion resistant film on the surface of steel strip for the purpose of lubricating other metal working processes, such as steel strip drawing; blanking; cold rolling; stamping; and the like.

DETAILED DESCRIPTION OF THE PREFERRED EMBODIMENTS

Figure 1:
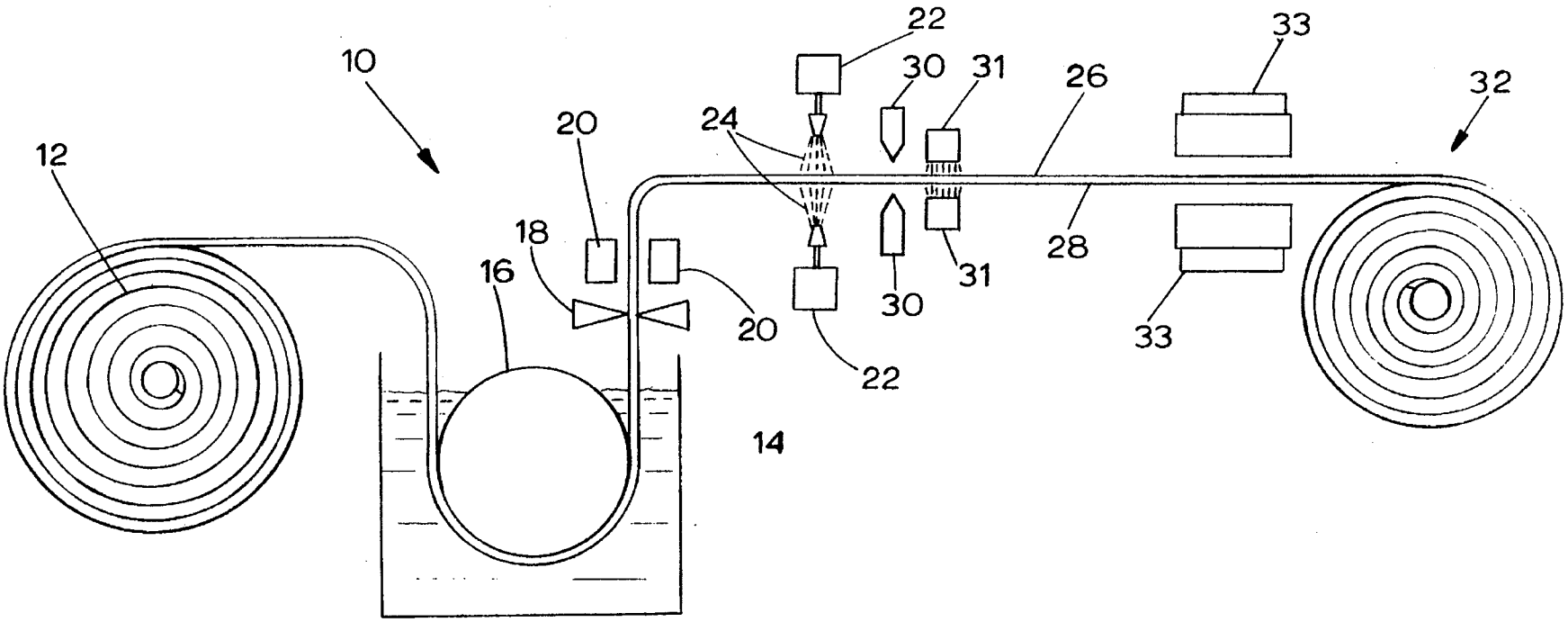
FIG. 1 is a schematic flow diagram of a method and apparatus for coating steel strip with a surface layer of zinc or aluminum, such as in a galvanizing, galvannealing, aluminizing, aluminnealing, galvalum or galvan process, showing application of an aqueous lubricant composition.

The preferred dry lubricant film-forming compositions applied in the steel processing methods of the present invention comprise a surfactant and an alkyl acid phosphate which, when applied together, provide superior corrosion protection and lubrication on steel surfaces, including but not limited to mild steel, aluminum-treated and zinc-treated steel surfaces. Optionally, the composition additionally contains dodecenylsuccinic acid (DDSA), and/or one or more other carboxylic acids having both a hydrophilic end and a hydrophobic end. The lubricating compositions can be applied to steel with or without neutralization. For example, it can be advantages to neutralize the compositions before applying them to zinc-coated steel. On the other hand, the compositions can be applied to mild steel without neutralization. In a preferred embodiment, the lubricating compositions are prepared and applied to steel surfaces as aqueous formulations.

The lubricating compositions provide superior corrosion protection and lubrication under normal and humid storage conditions, when compared to that provided by any of the individual components of the composition. The compositions show other advantages, including absence of zinc or chromate salts commonly associated with anti-corrosion agents. The compositions also can be prepared and applied to steel in the absence of significant volatile organic solvents such as kerosene; and they are non-flammable, and readily removable by a detergent wash before further processing, such as phosphate surface treatment and painting. The compositions are effective at low surface loading rates, compared with conventional lubricant coatings, such as petroleum-based Ship Oils, thereby providing economic advantages during application and greatly reduced waste disposal when the dry lubricant coating must be washed off. A further aspect of this invention is an increase in lubricity not heretofore achieved using a dry lubricant film for steel surfaces that are thereafter subjected to a metal processing operation, such as temper rolling.

The alkyl phosphates useful in the dry lubricating film-forming compositions are those of the general formula:

$$(RO)_m—P—(O)—(OH)_n$$

wherein

R is an alkyl group having about 4 to about 20 carbon atoms;

m is 1 or 2, and n is 3–m.

Mixtures of such alkyl phosphates also are useful in the lubricating compositions used in accordance with the present invention. In one embodiment of the lubricating composition, R is 100% $C_{10}$. In a preferred embodiment, the alkyl phosphate includes a mixture of radicals R from $C_8$ to $C_{16}$.

The surfactants useful in the dry lubricating film-forming compositions may be anionic, cationic, nonionic, or mixtures thereof, preferably nonionic surfactants. Non-ionic surfactants preferably have HLB values between 3.5 and 13 ("The HLB System" published by ICI America's Inc., Wilmington, Del.). Examples of surfactants are given in, but not limited to, those disclosed in Table 1.

TABLE I

| SURFACTANTS | | | | |
|---|---|---|---|---|
| Trade Name | Chemical | HLB | Dry Coating Wt. mg/ft$^2$ | Relative Corrosion Resistance |
| Control | No coating | | | 1 |
| NONIONIC | | | | |
| PLURONIC L92 | EO/PO* BLOCK | 1.0 | 173 | 8 |
| SPAN 85 | SORBITAN TRIOLEATE | 1.8 | 437 | 7 |
| TRITON X-15 | OCTYLPHENOXY POLYETHOXY ETHANOL | 3.6 | 619 | >120 |
| SPAN 80 | SORBITAN MONOOLEATE NF | 4.3 | 578 | >120 |
| LIPOCOL $C_2$ | PEO(2) CETYLETHER | 5.3 | 578 | >120 |
| SURFACTANT OF COMPOSITION 1 | $C_8$–$C_{20}$ PHOSPHATE ESTER EO ADDUCT | 6.7 | 492 | 80 |
| — | $C_{11}$–$C_{15}$ SECONDARY ALCOHOL ETHOXYLATE | 8.0 | 298 | >120 |
| TERGITOL NP-4 | NONYLPHENOL ETHOXYLATE | 8.9 | 451 | >120 |
| — | $C_8$ PHOSPHATE ESTER ALCOHOL ETHOXYLATE | 10.5 | 490 | >120 |
| TERGITOL NP-7 | NONYLPHENOL ETHOXYLATE | 11.7 | 295 | 80 |
| MERPOL SH | ALCOHOL ETHOXYLATE | 13.5 | 161 | 6 |
| IGEPAL CO-720 | NONYLPHENOL ETHOXYLATE | 14.2 | 139 | 7 |
| IGEPAL CO-970 | NONYLPHENOL ETHOXYLATE | 18.2 | 254 | 6 |
| ANIONIC | | | | |
| BOISOFT D-40 | SODIUM DODECYLBENZENE SULFONATE | — | 710 | 600 |
| DUPANOLC | SODIUM LAURYL SULFATE | — | 245 | 8 |
| AEROSOL 22 | — | — | 101 | 7 |
| AEROSOL OT | DIOCTYL ESTER OF SODIUM SULFOSUCCINIC ACID | — | 1101 | >600 |

TABLE I-continued

| SURFACTANTS | | | | |
|---|---|---|---|---|
| Trade Name | Chemical | HLB | Dry Coating Wt. mg/ft$^2$ | Relative Corrosion Resistance |
| CATIONIC | | | | |
| ARQUAD 16-50 | N-ALKYL TRIMETHYL AMMONIUM CHLORIDE | — | 1017 | 10 |

*Ethylene oxide/propylene oxide block copolymer.

In one embodiment of the lubricant composition, the surfactant and alkyl phosphate are mixed in water in a ratio by weight of from about 10:1 to 1:10 (surfactant: alkyl phosphate), preferably in a ratio of about 1.5:1 to about 3:1, to form an aqueous emulsion. The surfactant and alkyl phosphate can be added to the water sequentially or simultaneously, at any concentration level which supports the formation of the emulsion in water. A single phase solution after mixing is indicative of the formation of the emulsion.

The emulsion is adjusted with base to a pH of from about 6 to about 10, preferably from about 6.5 to about 8, and most preferably from about 7 to about 7.5. An alkali metal hydroxide, such as KOH, can be used, but any base which does not interfere with the formation or stability of the emulsion can be used, e.g., LiOH, NaOH, or ammonia. The emulsion can be diluted further with water to a final concentration for application to the metal surface. It is preferable to neutralize with an amine rather than an inorganic base. An amine can be added to the aqueous solution of the surfactant and alkyl phosphate. The amine may be a primary, secondary, or tertiary amine, chosen from alkylamines, alkanol amines, or aromatic alkyl amines. An amine containing a hydrophobic group appears to be the most effective. A preferred amine is N,N-dimethylcyclohexylamine. The aqueous emulsion comprising the neutralized alkyl phosphate, surfactant, and optionally the amine, provides effective corrosion protection and unexpected lubricity to steel surfaces in the form of a dried film. Examples of other amines are given in, but not limited to, Table 2.

TABLE 2

| Amine | Weight g | Emulsion pH | Dry Coating Wt. mg/ft$^2$ | Relative Corrosion Resistance |
|---|---|---|---|---|
| Dimethylcyclohexylamine | 10.0 | 7.3 | 1032 | 15 |
| Triethylamine | 7.9 | 7.7 | 463 | 6 |
| Tributylamine N,N-Dimethylbenzyl | 14.5 | 7.3 | LOW | <6 |
| Amine | 10.5 | 7.4 | 1154 | 48 |
| Diethylamine | 5.7 | 6.4 | 305 | 48 |
| Dibutylamine | 10.2 | 6.8 | LOW | <6 |
| Dibenzylamine | 15.5 | 6.6 | 514 | 6 |
| Phenethylamine | 9.5 | 7.2 | 341 | 7 |
| Triethanolamine | 11.7 | 7.4 | 564 | 120 |
| Diethanolamine | 8.3 | 7.4 | 540 | 30 |
| "Texlin" "300 | 4.0 | 7.4 | LOW | >600 |
| Control | | No coating | | 1 |

To achieve adequate corrosion inhibition and lubrication of steel surfaces, the lubricating composition should be applied to the steel surfaces in an amount sufficient to completely cover the surface of the steel with at least a monolayer of a dry film of the lubricating composition. In a preferred embodiment of the present invention, the lubricant is coated in an amount to provide at least about 7 mg/ft$^2$ of dry film. Any incompletely covered areas will corrode. The upper limit to the amount of the composition applied to the steel surface is controlled by cost constraints and practical limits as to the amount of material that can be applied to the surface. There is a point after which additional material is not beneficial in further inhibiting corrosion or increasing lubricity of steel-containing surfaces. It is advantageous from a material and cost standpoint to coat the steel surface at the lowest level practical which provides corrosion protection under the conditions of interest (temperature and humidity). This can be readily determined by visual observation. Mixtures of surfactant and neutralized alkyl phosphate are effective in inhibiting corrosion on, and lubricating steel surfaces at application rates of from about 1 mg/ft$^2$ to about 1,000 mg/ft$^2$.

In another embodiment, the lubricant composition includes dodecenylsuccinic acid (DDSA) together with the surfactant and alkyl phosphate, with or without neutralization, in a concentration of about 5% to about 40% by weight, relative to the combined amounts of surfactant and alkyl phosphate. DDSA greatly improves the corrosion-preventing properties of the combination of the surfactant and alkyl phosphate on zinc-treated steel under humid conditions.

In yet another embodiment, the lubricant composition includes another carboxylic acid together with the surfactant, alkyl phosphate, and DDSA in addition to, or in place of, DDSA. That additional carboxylic acid is effective with or without neutralizing the composition containing the additional carboxylic acid. The additional carboxylic acid used in this lubricant composition is a long chain hydrocarbon acid with a hydrophilic end and a hydrophobic end, for example a fatty acid, a branched alkyl carboxylic acid, a dimer acid and mixtures thereof (hereinafter referred to as "hydrophilic-hydrophobic acids"); specific examples include oleic acid, lauric acid, stearic acid, sebacic acid, adipic acid, $C_{18}$ unsaturated acids, and the like. The hydrophilic-hydrophobic acid is added at a concentration of from about 30% to about 110% by weight, based on the combined weight of surfactant and alkyl phosphate. The resulting composition can be neutralized with an inorganic base or an amine and further diluted prior to application to the metal surface.

The addition of a combination of DDSA and a hydrophilic-hydrophobic acid to the mixture of surfactant and neutralized alkyl phosphate provides the most effective dry film for corrosion protection and lubrication on zinc-treated steel surfaces, particularly under high humidity conditions. Such compositions are effective in inhibiting corrosion on zinc-coated steel surfaces at application rates of from about 1 mg/ft$^2$ to about 1,000 mg/ft$^2$. Mixtures of the surfactant, DDSA, and fatty acids/amine without the alkyl phosphate give much lower corrosion protection.

Preferably, the lubricant compositions are prepared in water and applied to steel as aqueous compositions. Thus, for example, the use of an aqueous composition for application to steel is advantageous because the presence of water lowers the viscosity of the composition, making it easier to apply it to steel. Also, the presence of water helps to control application rates of the compositions. On the other hand, it is possible to prepare and apply the compositions neat (i.e., no solvent or other liquid medium). If prepared neat, these compositions optionally can be diluted with water for application to the metal surface.

The lubricant composition can be applied to the surfaces of manufactured steel strip or stock or the like, with or without a galvanized or aluminized coating, by dipping, spraying, or other appropriate methods. The steel coated with the liquid lubricant composition then is dried by air jets, evaporation via latent heat contained in the steel surfaces being coated, or other appropriate method prior to conventional storage and transportation, or prior to a metal processing operation, such as temper rolling, leaving a dry, lubricant film. The treated steel, coated with the dry, lubricant film, is well protected from ambient moisture, either as liquid water or as ambient humidity, during storage and transportation.

Depending on the subsequent processing, removal of the dry lubricant film may be necessary, for instance prior to plating, painting, or surface coating. The dry film can be readily removed from the treated steel surfaces by washing with a solution of an appropriate alkaline surfactant in water.

The dry, lubricant film compositions impart enough lubricity to the metal surface that no additional surface treatment is necessary prior to other mill operations, such as temper rolling, cold rolling, drawing, blanking and/or stamping.

Lubricant Composition 1

To a 2 liter flask containing 1296 grams of water at 40° C. were added 60 grams of an ethoxylated octanol phosphate ester nonionic surfactant, with a HLB of 6.7; 24 grams of a mixed alcohol phosphate based on $C_8$, $C_{10}$ and $C_{12}$–$C_{16}$ alcohols in a ratio of 2.5:1.5:1; and 51 grams of ACINTOL® Fatty Acid 7002 (a mixture containing 83% dimer, trimer and higher molecular weight acids derived from the partial polymerization of those $C_{18}$ and $C_{20}$ fatty acids normally found in tall oil); 24 g of methanol; 5.8 g of xylene; 17.3 g of dodecenylsuccinic acid; and 22 g of dimethyl cyclohexylamine. The resulting mixture had a final pH of 7.4.

Zinc-coated steel coupons were dipped in the above Lubricant Composition 1 at ambient temperature and dried by evaporation in a laboratory hood. The resulting coupons were analyzed and determined to be coated with 1008 mg/ft$^2$ of the composition. The coated coupon showed 12% corrosion in three minutes using 0.5 Molar copper sulfate. Untreated coupons showed 100% corrosion in less than 5 seconds.

Control

Zinc-coated steel coupons (1"×4") treated with a formulation (530 mg/ft$^2$) based on Lubricant Composition 1, in which the alkyl phosphate was excluded, showed 50% discoloration (corrosion) from 0.5M $CuSO_4$ solution in 30 seconds, and 12% discoloration in 180 seconds at 1,000 mg/ft$^2$ for the phosphate-containing Lubricant Composition 1.

Lubricant Composition 2

To 1449 grams of water was added 15 grams of the nonionic surfactant used in Lubricant Composition 1; 6 grams of the mixed alkyl phosphate used in Lubricant Composition 1; and 12.8 g of ACINTOL® Fatty Acid 7002; 6 g of methanol; 1.5 g of xylene; 4.3 g of DDSA; and 5.5 g of N,N-dimethylcyclohexylamine. The final pH was 7.4.

Lubricant Composition 2 was applied to zinc-coated steel coupons to provide 50 mg/ft$^2$ of coating after application and evaporation to dryness. The treated coupons showed 100% corrosion in 70 seconds with 0.5M copper sulfate vs. 100% corrosion in <5 seconds for untreated coupons.

Additional Lubricant Compositions

Lubricant Composition 1 was repeated except that the surfactants set forth in Table 1 were substituted for the nonionic surfactant of Lubricant Composition 1. "Relative Corrosion Resistance" in Tables 1–3 is calculated by dividing the test time for a sample coated with the lubricant composition by the test time for an uncoated control, and dividing the resulting quantity by the amount of corrosion observed for the coated sample—e.g., coated sample showing 10% corrosion in 3 minutes v. control showing 100% corrosion in 0.5 minutes: [3/0.5]/0.1=60).

TABLE 3

| Acid | Relative Corrosion Resistance |
|---|---|
| No coating | 1 |
| Polymerized $C_{18}$–$C_{20}$ fatty acid mixture | 24 |
| Lauric acid | 14 |
| Oelic Acid | 86 |
| Stearic Acid | 13 |

The lubricity-enhancing effects achieved by treating surfaces with the lubricating compositions were demonstrated by measuring the static friction of metal coupons that were treated with Lubricant Compositions 1 and 2. The two solutions were prepared and applied to virgin galvanized strip steel, having a thickness of 0.030 inch, via spray techniques. Uniform 2"×4" metal coupons were cut from the treated strip and analyzed for coating pick-up via difference by weight. Representative samples from each dilution were then analyzed for static friction values by ASTM Method D 4518-91, Test Method A, using an inclined plane. Two treated coupons were placed face to face on a level plane, and a 500 gram weight was placed on the coupons to produce a force of 62.5 g per square inch of surface, and the inclination of the plane was increased at a rate of 14 degrees per minute. The static friction value was determined as the Tangent of the angle at which the two coupons just began to slide over one another. Triplicate values were determined for each pair of slides for each treatment.

| Example | Dry Coating Wt. | Average Angle of Slide | Static Friction |
|---|---|---|---|
| Control | 0 mg/ft$^2$ | 28.2 | 0.54 |
| Lubricant Composition 2 | 15 mg/ft$^2$ | 23.0 | 0.42 |
| Lubricant Composition 1 | 50 mg/ft$^2$ | 15.7 | 0.28 |

The dry lubricant film-forming composition may be applied as a liquid by employing one of the following techniques: dipping the steel strip through a bath of the composition, utilizing squeegees or wipers on opposite major surfaces of the strip to remove excess composition; three roll, reverse roll coating in which an applicator roll rotates in a direction which is the reverse of the direction of the advancing strip, at the location where the roll engages the strip; two roll, forward roll coating in which the applicator roll rotates in the same direction as the advancing strip, at the location where the roll engages the strip; electrostatic spraying; air assisted spraying; airless spraying; or any other method for coating a solid with a liquid. Roll coating may employ a gravure (patterned) pick-up roll surface or a smooth, patternless pick-up roll surface. In roll coating, the liquid lubricant composition is initially applied to a pick-up roll from which the liquid is transferred to an applicator roll. The techniques described above are all conventional expedients. Roll coating is preferred over spraying, and dipping is most effective, but costly to retrofit into an existing processing line. Among the spraying techniques, electrostatic spraying is preferred. Examples of some of these expedients and the advantages and disadvantages thereof are described in the Coduti, et al. U.S. Pat. No. 4,999,241.

Roll coating provides the best control from the standpoint of uniformity of thickness of the solid lubricant film. Electrostatic spraying produces a uniform weight per unit area for the lubricant film, but a uniform film thickness is difficult to obtain. Instead, the lubricant will be present as hills or valleys. Where uniformity of thickness is not a concern, and uniformity of weight per unit area is sufficient, electrostatic spraying may be employed.

The temperature of the moving steel strip may be adjusted before the film-forming lubricant material is applied for timely evaporation of water and/or other composition carrier(s) prior to processing of the lubricated steel strip at a succeeding metal working station, e.g., a temper mill.

Generally, absent a hot-dip coating step or a galvannealing step immediately upstream of the lubricant composition application procedure, the moving steel strip will be relatively cool, so that a temperature-raising step, preferably to a temperature in the range of about 100° F. (32° C.) to about 700° F. (371° C.), prior to application of the lubricant composition, is preferred for rapid evaporation of liquid from the lubricant composition. Alternatively, the applied lubricant composition can be heated after application, or subjected to other composition carrier evaporation means, e.g., infrared heating, or a vacuum evaporation step, to achieve a solid lubricant film on the steel strip prior to a subsequent steel strip manipulation operation where a surface lubricant is advantageous, e.g., temper rolling. A non-emission heating technique is preferred, such as induction heating or infrared radiant heating, both of which are conventional expedients. Both of these techniques will heat the lubricant composition or steel strip relatively rapidly to achieve a dry film of lubricant on the surface of the steel strip. Induction heating may be performed in a conventional induction heating furnace. Infrared radiant heating employs electric filaments heated by resistance heating and composed of a material which creates lightwave emissions heavily concentrated in the infrared part of the emission band.

Any type of steel strip heating expedient, or lubricant composition carrier evaporation process, may be employed for the evaporation of liquid from the applied aqueous lubricant composition. One such expedient comprises straight conduction heating with hot rolls which engage the strip, prior to lubricant composition application, and heat it as the strip passes therebetween. Another expedient employs a blast of very turbulent, non-laminar air super-heated to a temperature in the range of 600°–900° F. (316°–482° C.). Such temperatures do not destroy or degrade the advantages achieved with the preferred lubricant film-forming compositions disclosed herein.

After the lubricant application procedure, the steel strip may be coiled prior to the subsequent steel strip manipulation step, e.g., temper rolling.

Alternatively, the strip, having a solid lubricant film coating, can be processed, e.g., temper rolled, directly, without an intermediate coiling step.

Preferably, the steel strip should be at a temperature greater than 32° F. (0° C.) when the lubricant composition is applied to prevent freezing of the aqueous lubricant composition. Generally, steel strip preheating is required only in those cases where it is necessary to raise the temperature of the strip above 32° F. (0° C.). Such a situation would arise essentially only when the strip has been stored in a relatively cold environment immediately prior to performance of the steel processing method with which the lubricant application procedure has been combined.

The steel strip that is lubricated with a solid film in accordance with the present invention may be a steel strip that has been processed, e.g., galvanized, galvannealed, or aluminized, to apply a metal coating on the strip. In this embodiment, the metal coating may comprise zinc, aluminum, or iron alloys thereof, produced by dipping the steel strip in a hot bath of molten coating metal or by electrogalvanizing techniques. This embodiment will hereinafter be discussed principally in the context of zinc; however, such discussions are usually also applicable to aluminum and to alloys of iron with zinc or aluminum, unless otherwise indicated or apparent. In each such case, the lubricant is applied after the molten coating metal has solidified and the strip has cooled to a temperature less than about 1,000° F. (538° C.), preferably less than about 700° F. (371° C.).

When the lubricant is applied onto a hot dipped, e.g., galvanized, strip surface, it is not necessary to heat the steel strip for lubricant carrier evaporation between the hot-dipping metal coating step and the application of the liquid lubricant. This is because, at the time the lubricant is applied, the strip temperature is usually still high enough for lubricant composition carrier evaporation. Generally, a strip which has been coated with metal by a hot-dipping procedure, is subjected to a cooling procedure as part of the metal-coating operation. It is contemplated that the temperature of the metal-coated steel strip at the end of this conventional cooling procedure can be controlled, during that procedure, to provide the strip temperature desired at the time the lubricant composition is applied, e.g., 100°–700° F. (32°–371° C.).

In some conventional strip processing methods in which the strip is hot-dip coated with zinc, the strip is subjected to a galvannealing step, a conventional procedure in which, after coating, the strip is heated to a temperature at which the zinc in the coating and the iron in the steel strip alloy with each other. Such a processing method can be employed in combination with a lubricant application method in accordance with the present invention. In such a combination, the lubricant composition is applied after the surface metal-coating, e.g., galvannealing step.

The temperature of the galvannealed strip, at the time the lubricant composition is applied, should be below the temperature at which the lubricant composition degrades, for example, below about 1,000° F. (538° C.). If not, a chilling step can be used prior to the application of the lubricant. As noted above, when the strip is hot-dip coated with zinc or other molten metal, lubricant is applied thereafter, while the steel strip is hot, in the form of an aqueous solution or emulsion. The temperature of the steel strip can be adjusted, if necessary, by chilling the steel strip, before the lubricant is applied, to a temperature below the decomposition temperature of the lubricant but, of course, above at least the freezing point of water. Alternatively, after the lubricant has been applied, the steel strip can be heated to provide a strip temperature substantially above the boiling point of water, but below the decomposition temperature of the lubricant, to drive off the water from the aqueous lubricant composition before the strip is coiled or otherwise manipulated or further processed, e.g., by temper rolling.

Temper rolling is a cold-rolling operation that effects a relatively light reduction in thickness of steel strip. Temper rolling improves the flatness of the steel strip surface and/or provides the strip surface with a desired surface finish, alters mechanical properties of the steel strip, and/or reduces the tendency of the strip to flute (form creases when the steel is bent or otherwise deformed due to lack of springiness).

With existing conventional wet lubricants, it is necessary to elongate the sheet to a greater extent than when conventional dry lubricants are used, to achieve the same yield point elongation (YPE) and associated stretcher strain properties in the temper rolled steel. For example, when using (a) a conventional wet lubricant on the surface of steel strip undergoing temper rolling, the steel strip must be elongated via the temper rolling process about 1.6%, to achieve the same yield point elongation and associated stretcher strains in the steel strip as when using (b) dry lubricant temper rolling and elongating the steel strip only about 1.2%. Accordingly, using a dry lubricant during temper rolling has prevented the additional working roll force that was possible with the use of wet lubricants during temper rolling, resulting in lower elongation of the steel strip when a dry lubricant is used than when using a wet lubricant.

Surprisingly, it was discovered that by using the preferred dry lubricant compositions disclosed herein, temper rolling can be carried out to achieve a desired YPE while using the higher working roll pressures and/or strip tensions that were heretofore only possible when using a wet lubricant. The process of the present invention, therefore, can achieve greater elongation of at least about 1.5% in the steel strip, using a dry film lubricant. As a result, by using the preferred lubricant composition, one can achieve greater stretchability and/or more working roll force and/or more strip tension in the temper mill to provide a steel strip with desired mechanical properties. Further, the dry-lubricated steel strip can be temper rolled at high speeds, e.g., 4000–5000 ft/min.

Turning now to the drawing, and initially to FIG. 1, there is illustrated, schematically, a typical, molten metal coating process 10 for coating a roll of steel strip 12 with zinc or aluminum from molten metal bath 14. The roll of steel strip 12 is unrolled and passed through the molten metal bath 14 under a sinker roll 16 and excess molten metal coating is removed from the surfaces of the molten metal-coated strip by opposed wipers 18. In the preferred embodiment, the coated molten metal alloys with the iron in the surface of the steel strip 12 to form Zn/Fe or Al/Fe alloys over the entire surface area of the steel strip, with more Zn or Al near the coated surface of the strip 12. The distribution of Zn/Fe alloy in the outer surface of the steel strip can be controlled using a galvannealing furnace 20; the distribution of aluminum on the outer surface of the steel strip 12 can be controlled using galvalum (2–4% Al) or galvan (10–20% Al) processes, well known in the art.

The dry lubricant composition is applied to a steel strip surface, or to the Zn-coated or Al-coated surface of the steel strip, as shown in FIG. 1, such as by spray coating apparatus 22, which applies a coating of the aqueous lubricant composition 24 to completely cover at least the upper and lower major surfaces 26 and 28 of the metal coated steel strip 12. The amount of lubricant composition 24 applied to the strip 12 can be closely controlled from spray apparatus 22, or excess lubricant composition 24 can be wiped off of the major surfaces 26 and 28 using squeegee or wiping apparatus 30. The water carrier in the aqueous lubricant composition 24 evaporates due to the heat remaining in the Zn/Al coating or can be evaporated using a forced hot air apparatus 31 so that the lubricant composition is in the form of a continuous dry film before the strip 12 is re-rolled at coiling station 32. Optionally, the lubricant-coated steel strip 12 can be annealed, via annealing furnace 33, at a temperature, for example, in the range of about 100° F. to about 700° F., preferably about 450° F. to about 600° F., more preferably about 500° F. to about 520° F., prior to being re-rerolled at station 32, or prior to further processing, such as described with reference to FIG. 2.

Figure 2:
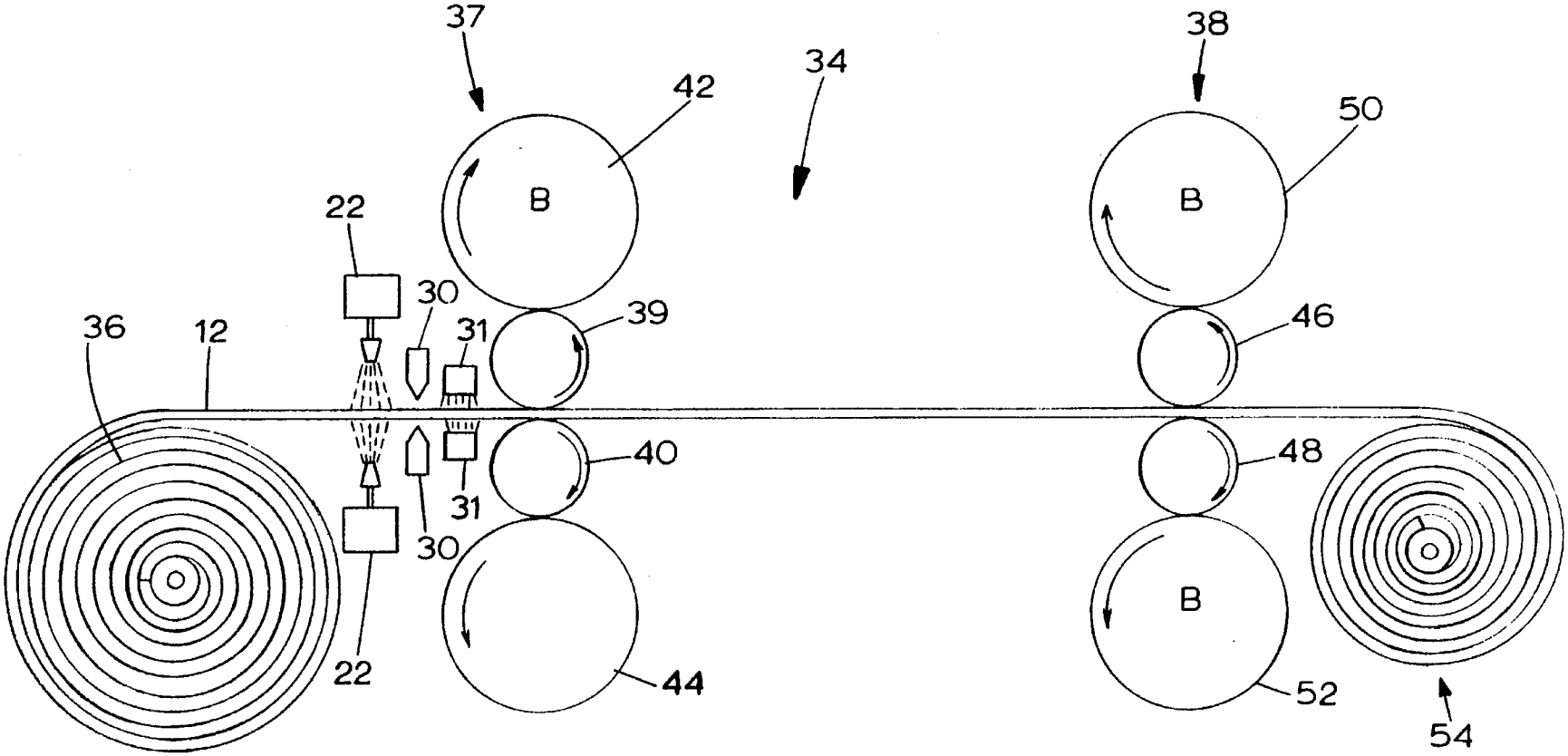
FIG. 2 is a schematic flow diagram of a two-stand, stand-alone temper mill, showing the application of an aqueous solution of a lubricant composition, and optional dryers for the lubricant, prior to temper rolling the steel strip.

Instead of re-rolling the strip 12 at coiling station 32, or after rolling the strip 12 at station 32, the strip 12 then is conveyed to a temper mill 34, illustrated schematically as a two-stand temper mill in FIG. 2. The steel strip 12, with or without a Zn or Al coating applied from the molten metal bath 14 of FIG. 1, is unrolled under tension from steel strip coil 36, or fed under tension, after being coated with lubricant from lubricant coating apparatus 22 of FIG. 1, to the in-line or stand-alone temper mill 34.

The temper mill 34 includes two stands, generally designated 37 and 38. It should be understood that the second temper mill stand 38 is optional, as is well known in the art. Lubricating composition spray apparatus 22, and wiping apparatus 30 or forced hot air apparatus 31, are shown in FIG. 2, as well as in FIG. 1, for the application of a layer of dry lubricating composition. The lubricating composition can be applied at either, or both, of the locations shown in FIGS. 1 and 2. The steel strip 12 is fed between a first pair of opposed upper and lower work rolls 39 and 40, respectively. Backup roll 42 applies force against the upper work roll 39, and backup roll 44 applies force against the lower work roll 40 to squeeze the steel strip 12 between the work rolls 39 and 40, thereby elongating the strip 12. Optionally, from the first pair of work rolls 39 and 40, the strip 12 continues, under interstand tension, to the second temper mill stand 38, between a second pair of upper and lower work rolls 46 and 48, respectively. A second stand pair of backup rolls 50 and 52 apply force against the upper and lower work rolls 46 and 48, respectively, to provide a desired degree of additional elongation to the strip 12.

From the second pair of work rolls 46 and 48, the temper-milled steel strip is maintained under back tension and rolled into a coil at coiling station 54. As is well known in a temper mill, the strip 12 is under tension enroute to the first pair of work rolls 39 and 40. The strip 12 is maintained under an "interstand tension" while the strip 12 is between (a) the first pair of work rolls 39 and 40 and (b) the second pair of work rolls 46 and 48; and the strip 12 is maintained under "back-up tension" between the second pair of work rolls 46 and 48 and the coiling station 54.

In accordance with an important feature of the present invention, the force applied by the working rolls 39, 40 and/or 46, 48 against the steel strip can be increased beyond a force heretofore used in a temper mill when a dry lubricant coating is applied to the steel strip. Further, the steel strip tension can be varied on route to the first pair of working rolls 39, 40; the interstand tension can be varied; and/or the back-up tension can be varied in accordance with the present invention, for better control of stretchability while achieving the desired mechanical properties, such as YPE, stretchability and yield strength.

In accordance with another important embodiment, the process of the present invention is particularly advantageous in cold rolling of steel strip when the dry lubricant composition is applied to the steel strip after acid pickling to provide corrosion protection and lubrication during tandem mill processing and/or subsequent temper rolling. A tandem mill is a well known expedient, very similar to the temper mill schematically illustrated in FIG. 2, but usually having 3, 4, 5 or 6 stands of working rolls, that cold rolls steel strip to substantially decrease the gauge (thickness) of the steel strip, for example, from about 0.200 inch to about 0.030 inch.

Figure 3:
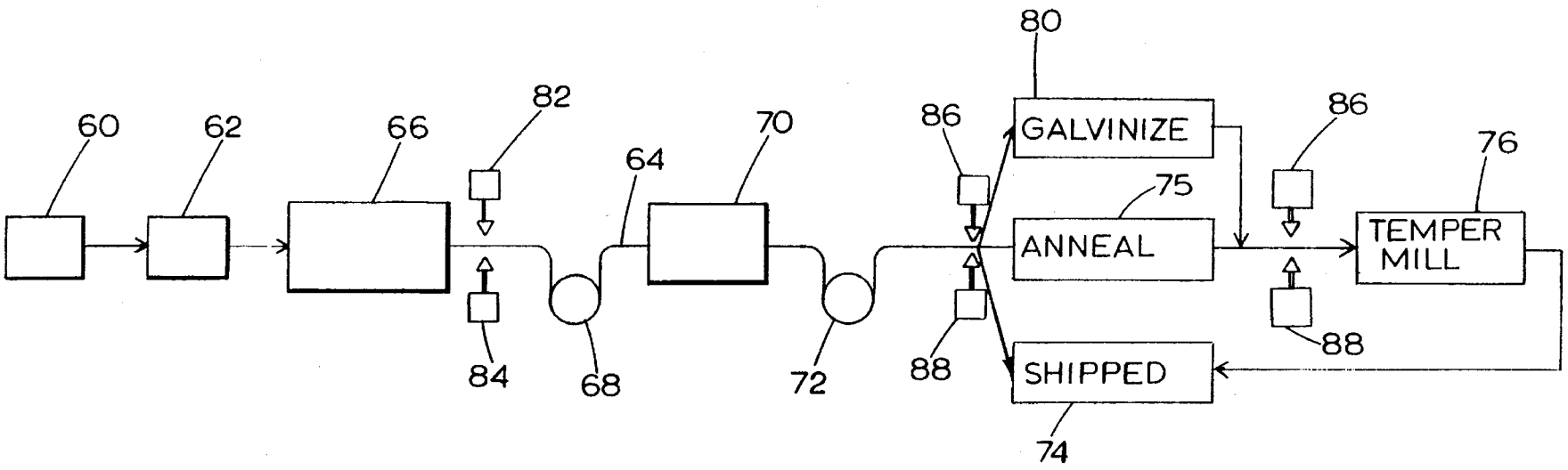
FIG. 3 is a schematic flow diagram of a tandem mill cold rolling process, including an acid pickling step for removal of iron oxides that form during the hot milling of a steel slab into a coil of steel strip; and including application of a lubricant prior to cold rolling in a tandem mill and/or a temper mill.

As shown schematically in FIG. 3, in the steel-making process steel slabs 60 are processed in a hot mill 62 into steel strip 64, and the steel strip 64 is usually coiled into a steel strip coil 66 before being uncoiled and sent through an acid-pickling tank 66. The acid-pickling tank 66 contains a bath of acid, e.g., hydrochloric acid, and the hot milled steel strip 64 is submerged through the acid bath to remove iron oxides before the steel strip 64 is coiled to form steel strip coil 68. Steel strip coil 68 then is uncoiled and cold rolled, e.g., in a tandem mill 70. The steel strip exiting the tandem mill 70 may be coiled again at 72 for shipment at shipping station 74, or the strip 64 may go directly to an annealing furnace 75 and/or to a temper mill 76 before shipment at shipping station 74. Alternatively, the steel strip from tandem mill 70 may proceed, before or after coiling, to a hot metal, e.g., Zn or Al, coating process, such as galvanizing process 80.

As shown in FIG. 3, the lubricating composition can be applied to the steel strip 64 from lubricating composition coating spray apparatus 82, 84 after the strip 64 exits from the acid-pickling tank 66 to provide corrosion protection to the strip and for lubrication of the strip during further processing in the tandem mill 70. Alternatively, or in addition to applying the lubricating composition between the acid-pickling tank 66 and the tandem mill 70, the lubricating composition can be applied to the steel strip from coating apparatus 86, 88, as shown in FIG. 3, between the annealing furnace 75, and the temper mill 76, or after the annealing furnace 75.

What is claimed is:

1. A method of increasing the stretchability of a strip of steel comprising:

annealing the steel strip:

applying to a surface of said steel strip, before or after said strip has been annealed, a coating of a liquid lubricant;

thereafter drying said liquid lubricant to form a dry lubricant film on said steel surface in an amount of at least 1 mg/ft$^2$; and rolling said steel strip, having said dry lubricant film thereon, between at least one pair of steel mill in-line temper rollers, under pressure sufficient to elongate and reduce a thickness of said steel strip.

2. A method in accordance with claim 1, wherein said lubricating composition is a mixture comprising water; a surfactant; and at least one alkyl phosphate, in a surfactant: phosphate weight ratio in the range of about 10:1 to 1:10, said phosphate having the general formula:

$(RO)_m$—P—(O)—$(OH)_n$ wherein

R is an alkyl group having about 4 to about 20 carbon atoms;

m is 1 or 2, and n is 3–m.

3. A method in accordance with claim 1, wherein the liquid lubricant is free from organic solvent.

4. A method in accordance with claim 1, wherein the steel strip, prior to coating with the liquid lubricant, includes a coating of metal selected from the group consisting of zinc, aluminum, an alloy of iron and zinc, an alloy of iron and aluminum, and mixtures thereof.

5. A method in accordance with claim 1 further including the step of annealing the lubricant-coated strip before or after rolling said steel strip, without substantial loss of lubricant or corrosion resistance.

6. The method of claim 2, wherein the lubricating composition further includes about 5% to about 40% by weight, based on the combined weight of said surfactant and said phosphate, of at least one carboxylic acid which has both a hydrophilic and a hydrophobic portion.

7. The method of claim 2, wherein the phosphate portion of the lubricant has an alkyl radical R containing 10 carbon atoms.

8. The method of claim 2, wherein said ratio of surfactant to alkyl phosphate is in the range between 1:3 and 1:1.5.

9. The method of claim 2, wherein said alkyl phosphate is amine-neutralized.

10. The method of claim 2 in which at least one of said acids in the lubricant film is dodecenylsuccinic acid.

11. The method of claim 7, wherein R is a mixture of alkyl groups containing about 8 to about 16 carbon atoms.

12. The method of claim 9, wherein said phosphate is neutralized by N,N-dimethylcyclohexylamine.

13. The method of claim 10, wherein the lubricant film additionally contains at least one other carboxylic acid which has both a hydrophilic and a hydrophobic portion.

14. A method in accordance with claim 3, wherein the liquid lubricant includes a liquid carrier consisting essentially of water.

15. A method in accordance with claim 4, wherein the metal coated steel strip is metal coated by a process selected from the group consisting of galvanizing, galvannealing, and aluminizing.

16. A method in accordance with claim 5, wherein the annealing step is at a temperature in the range of about 450° F. to about 600° F.

17. A method of manufacturing steel strip comprising:

hot milling a slab of steel to form steel strip from said slab;

conveying said steel strip through an acid bath for removal of iron oxides from said steel strip;

rinsing said steel strip with a rinsing liquid comprising water for removal of acid from said steel strip;

annealing said steel strip;

applying to a surface of said steel strip, before or after said steel strip has been annealed, a coating of a liquid lubricant; thereafter drying said liquid lubricant no form a dry lubricant film on said steel surface in an amount of at least 1 mg/ft$^2$ to improve the corrosion resistance of said steel strip; and rolling said steel strip, having said dry lubricant film thereon, between a pair of steel mill in-line temper rollers, under pressure sufficient to elongate and reduce a thickness of said steel strip.

18. A method in accordance with claim 17, wherein rinsing of said steel strip is accomplished by rinsing with an aqueous composition containing said liquid lubricant to accomplish rinsing and application of said liquid lubricant in a single step.

19. A method in accordance with claim 17, wherein the step of annealing the lubricant-coated strip is performed before or after temper rolling said steel strip, without substantial loss of lubricant or corrosion resistance.

20. A method in accordance with claim 17, wherein said lubricating composition is a mixture comprising water; a surfactant; and at least one alkyl phosphate, in a surfactant-:phosphate weight ratio in the range of about 10:1 to 1:10, said phosphate having the general formula:

$(RO)_m$—P—(O)—$(OH)_n$ wherein

R is an alkyl group having about 4 to about 20 carbon atoms;

m is 1 or 2, and n is 3–m.

21. A method in accordance with claim 18, wherein rinsing and lubricant applying are accomplished after said steel strip is conveyed through said acid bath, by conveying said steel strip through a bath of said aqueous lubricant composition.

22. A method in accordance with claim 20, wherein the annealing step is at a temperature in the range of about 100° F. to about 700° F.

23. The method of claim 20, wherein the lubricating composition further includes about 5% to about 40% by weight, based on the combined weight of said surfactant and said phosphate, of at least one carboxylic acid which has both a hydrophilic and a hydrophobic portion.

24. The method of claim 20, wherein the phosphate portion of the lubricant has an alkyl radical R containing 10 carbon atoms.

25. The method of claim 20, wherein said ratio of surfactant to alkyl phosphate is in the range between 1:3 and 1:1.5.

26. The method of claim 20, wherein said alkyl phosphate is amine-neutralized.

27. The method of claim 20 in which at least one of said acids in the lubricant film is dodecenylsuccinic acid.

28. The method of claim 24, wherein R is a mixture of alkyl groups containing about 8 to about 16 carbon atoms.

29. The method of claim 26, wherein said phosphate is neutralized by N,N-dimethylcyclohexylamine.

30. The method of claim 27, wherein the lubricant film additionally contains at least one other carboxylic acid which has both a hydrophilic and a hydrophobic portion.

31. A method of reducing a thickness of steel strip comprising:

coating said steel strip with a film of a dry lubricant in an amount of at least 1 mg/ft$^2$; and cold rolling said steel strip, having said dry lubricant film thereon, between a pair of steel mill in-line temper rollers, under pressure sufficient to achieve yield point elongation.

32. A method of making steel strip comprising:

hot milling a steel slab to elongate said slab and reduce its thickness, thereby forming a steel strip;

contacting said steel strip with an acid solution to separate iron oxides from the surfaces of said steel strip;

rinsing said steel strip with an aqueous solution of a lubricant to rinse acid and iron oxides from said steel strip and to provide a film of dry lubricant on said steel strip in an amount of at least 1 mg/ft$^2$; and cold rolling said steel strip, having said dry lubricant film thereon, between a pair of steel mill in-line temper rollers, under pressure sufficient to achieve yield point elongation.

* * * * *